US008998789B2

(12) United States Patent
Toi et al.

(10) Patent No.: US 8,998,789 B2
(45) Date of Patent: Apr. 7, 2015

(54) CONTINUOUS CENTRIFUGE

(75) Inventors: Hiroatsu Toi, Ibaraki (JP); Eiichi Fukuhara, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 1099 days.

(21) Appl. No.: 13/021,091

(22) Filed: Feb. 4, 2011

(65) Prior Publication Data

US 2011/0190111 A1 Aug. 4, 2011

(30) Foreign Application Priority Data

Feb. 4, 2010 (JP) ..... 2010-022921
Oct. 20, 2010 (JP) ..... 2010-235079

(51) Int. Cl.
*B04B 11/02* (2006.01)
*B04B 15/00* (2006.01)

(52) U.S. Cl.
CPC ..... *B04B 11/02* (2013.01); *B04B 15/00* (2013.01)

(58) Field of Classification Search
USPC ..... 494/7, 27, 29, 30, 61
See application file for complete search history.

(56) References Cited

U.S. PATENT DOCUMENTS

| | | | | |
|---|---|---|---|---|
| 7,591,775 | B2 | 9/2009 | Tobita et al. | |
| 2003/0008758 | A1 | 1/2003 | Astheimer et al. | |
| 2004/0214711 | A1 | 10/2004 | Aizawa et al. | |
| 2008/0251436 | A1 * | 10/2008 | Tetsu et al. | 210/145 |
| 2008/0300124 | A1 * | 12/2008 | Akatsu et al. | 494/14 |
| 2009/0239729 | A1 * | 9/2009 | Tobita et al. | 494/14 |
| 2010/0075823 | A1 * | 3/2010 | Toi et al. | 494/6 |
| 2011/0028297 | A1 * | 2/2011 | Tobita et al. | 494/37 |

FOREIGN PATENT DOCUMENTS

| | | | |
|---|---|---|---|
| JP | 62-171740 | A | 7/1987 |
| JP | 02-201196 | A | 8/1990 |
| JP | 06-099100 | A | 4/1994 |
| JP | 2004528966 | A | 9/2004 |
| JP | 2004322054 | A | 11/2004 |
| JP | 2006-21121 | A | 1/2006 |
| JP | 2008054732 | A | 3/2008 |

OTHER PUBLICATIONS

Notification of Reasons for Refusal for Japanese Patent App. No. 2010-235079 (Apr. 21, 2014) with English language translation thereof.

* cited by examiner

*Primary Examiner* — Charles Cooley
*Assistant Examiner* — Marc C Howell
(74) *Attorney, Agent, or Firm* — Kenealy Vaidya LLP

(57) ABSTRACT

A continuous centrifuge includes: a cylindrical rotor configured to separate a specimen; a centrifuging chamber accommodating the rotor; a driving unit configured to rotate the rotor; a specimen line configured to continuously supply and discharge the specimen to and from the rotor during rotation of the rotor; and a controller configured to control the driving unit. The control unit has a cleansing mode which flows a liquid chemical through the specimen line so as to conduct sterilization and/or cleansing while rotating the rotor.

14 Claims, 8 Drawing Sheets

CONTINUOUS CENTRIFUGE

BACKGROUND

The disclosure relates to a continuous centrifuge that continuously flows a specimen so as to centrifuge particles in the liquid specimen in the rotor, and particularly to a continuous centrifuge provided with a cleansing mode for cleansing or sterilization inside the rotor.

A centrifuge is an apparatus that separates particles which do not sink or rarely sink in a general gravitational field, and viruses, fungus body or the like may be the subject of such separation. Viruses or fungus body are essential raw materials for the manufacture of medicines, vaccines or the like, and a continuous centrifuge is widely used as an apparatus that separates and purifies raw materials in the manufacturing process of medicines, vaccines or the like. A continuous centrifuge includes a line for flowing a specimen, which is constituted with a rotor which rotates at a high speed, two rotation shafts which are connected to the top and bottom of the rotor and include through holes, or the like. Since a continuous centrifuge sometimes deals with a specimen, such as an influenza vaccine, it is important to sterilize and/or cleanse the specimen line after operation in such cases.

In general, after an operation of a continuous centrifuge is finished, it is common to take the rotor out of the centrifuging chamber and then disassemble and sterilize and/or cleanse the rotor for which cleansing machines or the like have been produced. It takes at least 20 to 30 minutes or more to take out and disassemble a rotor, and, furthermore, it often takes 30 minutes or more to cleanse the removed rotor, and fixing the cleansed rotor back to the centrifuging chamber also takes a similar amount of time to taking out and disassembling the rotor. Therefore, provided is a continuous centrifuge equipped with a sterilization mode for conducting Steam in Place (SIP) sterilization in which vapor is flowed through a specimen line without taking the rotor out of the centrifuging chamber. For example, the continuous centrifuge described in JP-A-2006-21121 is equipped with a mode commonly known as a sterilization mode in which sterilization of the specimen line is conducted using vapor without taking the rotor out.

SUMMARY

In the sterilization mode of JP-A-2006-21121, sterilization is conducted with the rotation of the rotor stopped, and sterilization of the specimen line is reliably conducted by controlling the vapor temperature at 121° C. or higher. On the other hand, in order to conduct such vapor sterilization, a high-priced and very large vapor generator, temperature controlling system and pipes are required. In addition, part of the continuous centrifuge also needs to be replaced with members capable of enduring the flow of high-temperature vapor. As a result, the production costs of continuous centrifuges are increased, therefore it is desired to realize an effective sterilization mode at a low price.

An aspect of the disclosure provides a continuous centrifuge capable of effectively sterilizing or cleansing the specimen line without taking out the rotor.

Another aspect of the disclosure provides a continuous centrifuge that sterilizes by flowing a liquid chemical through the specimen line and includes an operation mode increasing the sterilization effect (cleansing mode).

The other aspect of the disclosure provides a continuous centrifuge that appropriately controls the reduced-pressure level in the rotor chamber during the cleansing mode in which a liquid chemical is flowed through the specimen line for sterilization, thereby achieving energy saving.

The aspects of the disclosure provides the following arrangements.

(1) A continuous centrifuge comprising:

a cylindrical rotor configured to separate a specimen;

a centrifuging chamber accommodating the rotor;

a driving unit configured to rotate the rotor;

a specimen line configured to continuously supply and discharge the specimen to and from the rotor during rotation of the rotor; and a controller configured to control the driving unit, wherein the control unit has a cleansing mode which flows a liquid chemical through the specimen line so as to conduct sterilization and/or cleansing while rotating the rotor.

(2) The continuous centrifuge according to (1), wherein in the cleansing mode, the controller controls the driving unit to rotate the rotor at a low speed enough to discharge air bubbles left inside the rotor to the specimen line.

(3) The continuous centrifuge according to (2), wherein the rotation speed of the rotor in the cleansing mode is 1/10 or less of a maximum rotation speed of the rotor.

(4) The continuous centrifuge according to any one of (1) to (3) further comprising a vacuum pump connected with the centrifuging chamber to reduce inside pressure of the centrifuging chamber, wherein in the cleansing mode, the controller controls the driving unit to rotate the rotor in a state in which pressure-reduction level in the centrifuging chamber is closer to atmospheric pressure than in a general operation mode.

(5) The continuous centrifuge according to (4), wherein the vacuum pump is stopped during an operation in the cleansing mode.

(6) The continuous centrifuge according to any one of (1) to (5), wherein the control unit stores the operation state of the cleansing mode.

(7) The continuous centrifuge according to (6), wherein the control unit determines whether the cleansing mode has been finished based on the stored operation state when an operator directs a general centrifuging operation, and in a case in which the cleansing mode has not been finished, the control unit does not start the general continuous centrifuging operation.

(8) The continuous centrifuge according to any one of (1) to (7) further comprising an operating panel configured to display operation states, wherein an icon is displayed on the operating panel to direct start of the cleansing mode.

(9) A continuous centrifuge comprising:

a cylindrical rotor configured to separate a specimen;

a centrifuging chamber accommodating the rotor;

a driving unit configured to rotate the rotor;

a specimen line configured to continuously supply and discharge the specimen to and from the rotor during rotation of the rotor, the specimen line including an upper specimen line and a lower specimen line; and a controller configured to control the driving unit, wherein the control unit has a cleansing mode which flows a liquid chemical through the specimen line so as to conduct sterilization and/or cleansing while rotating the rotor, and wherein in the cleansing mode, the controller switches flowing direction of the liquid chemical from one of the upper specimen line and the lower specimen line.

(10) The continuous centrifuge according to claim (9) further comprising:

a specimen tank accommodating the liquid chemical to be supplied to the rotor;

a liquid waste tank accommodating a liquid waste discharged from the rotor;

a supply pump configured to send the liquid chemical from the specimen tank; and a switch valve configured to supply the liquid chemical from the specimen tank to one of the upper specimen line and the lower specimen line by the supply pump.

(11) The continuous centrifuge according to (10), wherein the switching valve includes an electromagnetic valve, and the control unit controls activates the electromagnetic valve so as to switch a connection from the specimen tank to one of the upper specimen line and the lower specimen line.

(12) The continuous centrifuge according to (11), wherein, in the cleansing mode, sterilization liquid or cleansing liquid as the liquid chemical is supplied from the specimen tank through the lower specimen line to the rotor, and then the liquid chemical is supplied from the specimen tank through the upper specimen line to the rotor.

(13) The continuous centrifuge according to (12), wherein, in the cleansing mode, control is made to repeatedly alternate the connection from the specimen tank to the lower specimen line and the connection from the specimen tank to the upper specimen line.

(14) A continuous centrifuge comprising:

a cylindrical rotor configured to separate a specimen;

a centrifuging chamber accommodating the rotor;

a driving unit configured to rotate the rotor;

a specimen line configured to continuously supply and discharge the specimen to and from the rotor during rotation of the rotor; and a controller configured to control the driving unit, wherein the control unit has a general centrifuging operation mode which flows the specimen through the specimen line and control the driving unit to rotate the rotor at a first speed so as to separate the specimen, and a cleansing mode which flows a liquid chemical through the specimen line and rotate the rotor at a second speed which is 1/10 or less of the first speed so as to conduct sterilization and/or cleansing while rotating the rotor.

DESCRIPTION OF EXEMPLARY EMBODIMENTS

Embodiment 1

Figure 1:
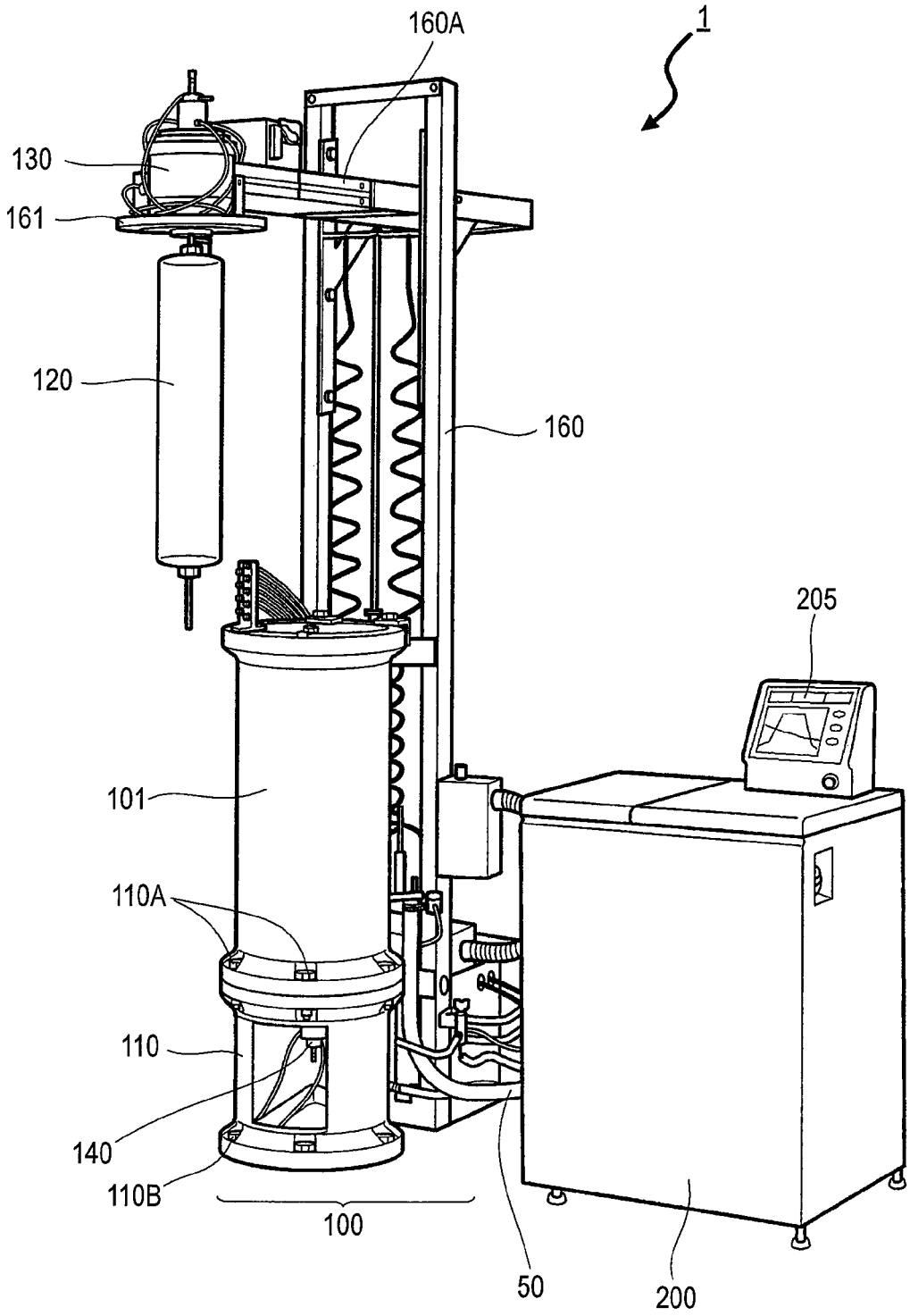
FIG. 1 is a perspective view showing the entire continuous centrifuge according to an embodiment.

Hereinafter, exemplary embodiments will be described with reference to the accompanying drawings. Meanwhile, in the drawings below, similar units will be given similar reference numerals, and the description thereof will not be repeated.

FIG. 1 is a perspective view showing the entire continuous centrifuge according to the exemplary embodiment. As shown in FIG. 1, the continuous centrifuge 1 is a so-called continuous ultracentrifuge used for the manufacturing process of vaccines or the like, and includes a centrifuging unit 100 and a control apparatus 200. The centrifuging unit 100 and the control apparatus 200 are connected with a wiring and pipe group 50.

Figure 2:
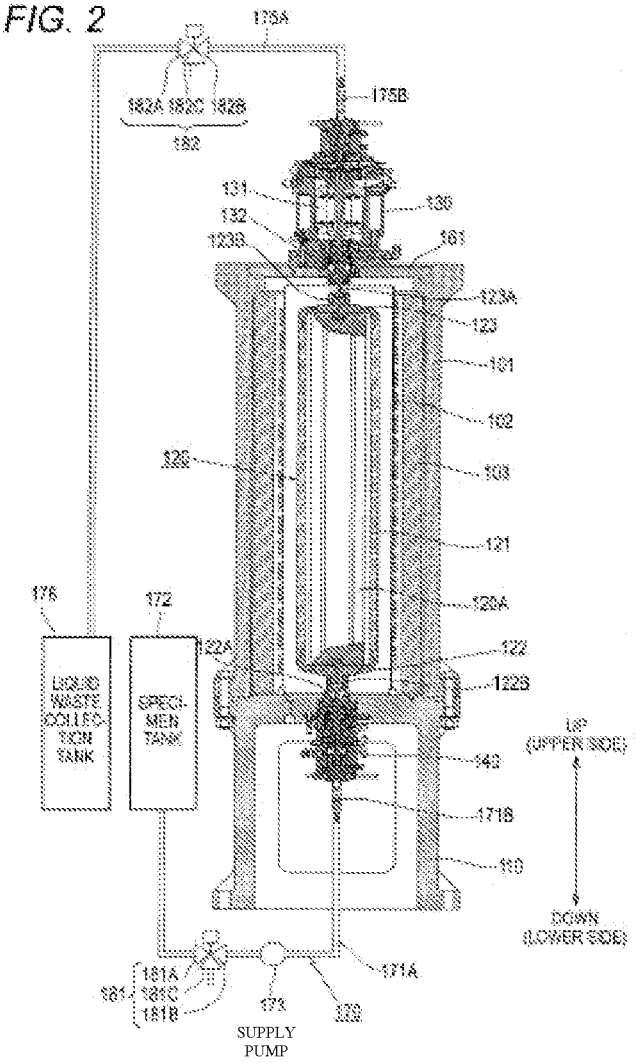
FIG. 2 is a cross-sectional view showing the detailed structure of the centrifuging unit 100 in FIG. 1.

The centrifuging unit 100 includes a cylindrical chamber 101 which is a centrifuging chamber, a base 110 supporting the chamber 101, a rotor 120 which is accommodated in the chamber 101 in a manner in which the rotor 120 can be freely put in and taken out and rotates at a high speed, a driving unit 130 which is disposed above the chamber 101 and rotary-drives the rotor 120 in a dangling state, a lower bearing unit 140 fixed to the bottom of the chamber 101, a lift 160 and an arm 160A for moving the driving unit 130 upward, downward, forward and backward, and a specimen circulating unit 170 which continuously feeds and discharges a specimen or a liquid chemical (sterilization liquid) to and from the rotor 120 (refer to FIGS. 1 and 2). The chamber 101 accommodates the rotor 120 dangling from the driving unit 130 therein.

Since the rotor 120 is generally rotary-driven at a high speed during operation, the inside of the chamber 101 is maintained in a pressure-reduced state during centrifuging in order to suppress windage loss due to the atmosphere or heating due to frictional heat. In order to put the inside of the chamber 101 in a pressure-reduced state, a discharging opening, not shown, which discharges air in the chamber 101 is formed in the body of the chamber 101. The chamber 101 is fixed to the base 110 with a plurality of bolts 110A, and the base 110 is fixed to the floor surface with a plurality of bolts 110B.

The control apparatus 200 accommodates a refrigerating machine, not shown, for cooling the entire centrifuging chamber in the chamber 101, a vacuum pump, not shown, for putting the centrifuging chamber in the chamber 101 in a pressure-reduced state, a lift driving apparatus, not shown, for moving the rotor 120 to predetermined positions, a control unit, not shown, which driving-controls the rotor 120, or the like, and has an operating panel 205 where operating and inputting are conducted disposed on the top. The control unit includes electronic circuits including a microcomputer and a storage apparatus, neither of which is shown, and conducts not only the driving-control of the rotor 120 but also the control of the entire continuous centrifuge.

FIG. 2 is a cross-sectional view showing the detailed structure of the centrifuging unit 100 in FIG. 1. The chamber 101 accommodates the rotor 120 dangling from the driving unit 130 therein, a cylindrical evaporator (vaporization pipe) 102 disposed so as to cover the circumference of the rotor 120, and a cylindrical protector 103 installed outside the evaporator 102. The protector 103 is installed to prevent, in a case in which the rotor 120 is broken for some reason during rotation, the fragments thereof or a specimen from flying away outward, thereby keeping the fragments or the specimen inside the chamber 101, which is a role of a protective wall. The evaporator 102 includes copper pipes which circulate a refrigerant gas so that the inside of the chamber 101 can be cooled, thus making it possible to cool the inside of the chamber 101.

The rotor 120 includes a cylindrical rotor body 121, an upper rotor cover 123 and a lower rotor cover 122 fixed with screws to the top and bottom of the rotor body 121. The driving unit 130 is fixed to an upper plate 161, described below, which forms a single body with the lift 160 (refer to FIG. 1), and includes a motor 131, a bearing unit 132 or the like. The motor 131 uses an upper shaft 123A as a rotating shaft, and the bearing unit 132 rotatably supports the upper shaft 123A at the top and bottom of the motor 131. Since the upper rotor cover 123 is fixed to the bottom end of the upper shaft 123A with nut 123B, the rotor 120 dangles from the driving unit 130.

Specimen passing holes are formed at the shaft center positions on the upper rotor cover 123 and the lower rotor cover 122, respectively, and the upper shaft 123A and a lower shaft 122A which are rotating shafts are fixed to the upper rotor cover 123 and the lower rotor cover 122. Specimen passing holes which are an upper passage and a lower passage pass through the shaft centers of the upper shaft 123A and the lower shaft 122A, respectively, and the specimen passing holes are communicated with the specimen passing holes formed on the upper rotor cover 123 and the lower rotor cover 122, respectively. By rotating the upper shaft 123A at a high speed by the driving of the motor 131 included in the driving unit 130, the rotor 120 fixed to the upper shaft 123A and the lower shaft 122A fixed to the rotor 120 with the nut 122B are rotated together at a high speed.

In addition, a core 120A is disposed in the rotor 120 in a manner in which the core can be freely put in and taken out, and, when conducting centrifuging, a specimen injected from the lower shaft 122A passes through the specimen passing holes so as to be introduced to the rotor 120, and the specimen introduced to the rotor 120 is moved by the core 120A to a high centrifugal field so as to be separated into sedimentation and supernatant, and the supernatant (liquid waste) is discharged through the specimen passing hole on the upper shaft 123A.

The specimen circulating unit 170 includes specimen pipes 171, a specimen tank 172, a specimen supply pump 173 and a liquid waste collection tank 176. The specimen pipes 171 connect the specimen tank 172 and the lower bearing unit 140, and the driving unit 130 and the liquid waste collection tank 176, and have a lower connector 171B near the lower bearing unit 140 and an upper connector 175B near the driving unit 130. The lower bearing unit 140 is provided adjacent to the chamber 101 of the base 110.

The specimen tank 172 stores a specimen which is to be centrifuged in the rotor 120, and the specimen supply pump 173 pressure-feeds a specimen to the lower bearing unit 140. The liquid waste collection tank 176 stores the supernatant (liquid waste) of a specimen, which has been centrifuged in the rotor 120. The space in which a specimen is pressure-fed by the specimen supply pump 173 from the specimen tank 172 to the lower pipe 171A, passes through the lower bearing unit 140 and then flows into the rotor 120 in which the specimen is centrifuged, and then passes through the upper pipe 175A from the driving unit 130 to the liquid waste collection tank 176 is defined as the specimen circulation line. Further, three-way valves 181 and 182 are inserted between the specimen tank 172 and the specimen supply pump 173 and between the upper connector 175B and the liquid waste collection tank 176. The three-way valve 181 has a passage 181A and a passage 181B communicated with each other, and therefore forms a flow path so that a specimen can flow from the specimen tank 172 to the lower pipe 171A. The three-way valve 182 has a passage 182A and a passage 182B communicated with each other, and therefore forms a flow path so that a centrifuged supernatant fluid can flow from the upper connector 175B to the liquid waste collection tank 176 through the upper pipe 175A. Further, the three-way valve 181 can communicate an arbitrary two of three passages 181A, 181B and 181C. Likewise, the three-way valve 182 can communicate an arbitrary two of three passages 182A, 182B and 182C.

Further, FIG. 2 shows a view in which a liquid chemical is flowed from the lower side to the upper side, but it is also possible to discharge air bubbles in the rotor 120 by disposing a flow path switching valve for switching the upward and downward movement of the flow of a liquid chemical in the specimen circulation unit 170, thereby switching the upward and downward movement of the flow of a liquid chemical.

Figure 3:
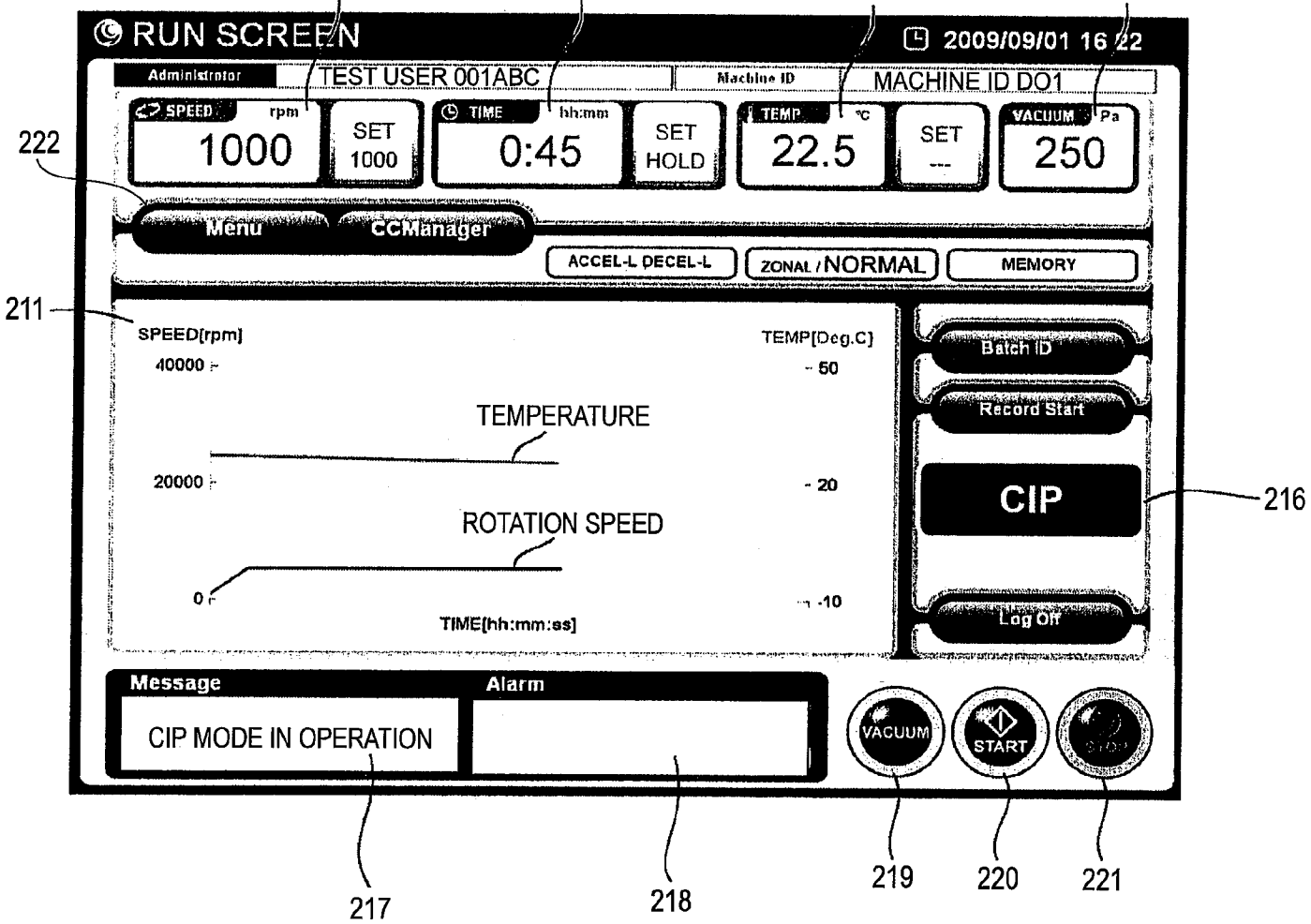
FIG. 3 is a view showing a screen displayed on the operating panel 205 in FIG. 1.

FIG. 3 is a view showing an example of a display on the operating panel 205. A CIP button 216 which acts as the start button of the cleansing mode is disposed on the operating panel 205. The "cleansing mode" started by pushing the CIP button 216 in the present embodiment refers to a mode of cleansing operation, sterilization operation and an operation including cleansing and sterilization, and is conducted by a separate control independently from an operation mode when continuously centrifuging a specimen. The operating panel 205 includes, for example, a touch sensor-type liquid crystal display screen, and a variety of information of a rotation speed display part (area) 211 (unit: RPM), an elapsed time display part (area) 212 (unit: hours and minutes), a chamber temperature display part (area) 213 (unit: ° C.), a degree of vacuum in the chamber display part (area) 214 (unit: Pa) or the like is displayed in the upper side of the display parts.

Each of the display parts of the rotation speed display part 211, the elapsed time display part 212 and the chamber temperature display part 213 includes a region displaying the current condition in the left and a region displaying the setting condition in the right. A trend display part (area) 215 is provided in the middle portion of the operating panel 205 to display the progress of the rotation speed and temperature of the rotor 120 with respect to the elapsed time. FIG. 3 shows an example of a graph in which the horizontal axis represents time and the vertical axis represents the rotation speed of the rotor and the temperature of the rotor. Based on the displayed graph, an operator can recognize immediately whether the rotation speed and temperature of the rotor are normal or not.

A message display part (area) 217 for displaying a message for an operator and an alarm display part (area) 218 for displaying an alarm to an operator when an abnormality occurs are provided in the bottom range of the trend display part 215. In the example of FIG. 3, the message display part 217 displays a message of "CIP mode in operation" which shows that an operation is pending in a cleansing mode, by which an operator can recognize a selected mode or a mode in operation. Furthermore, a vacuum button 219 for driving a vacuum pump, not shown, to reduce the pressure in the chamber 101, a start button 220 for starting the rotation of the rotor 120 and a stop button 221 for stopping the rotor 120 in rotation are displayed in the lower right portion of the operating panel 205.

Figure 4:
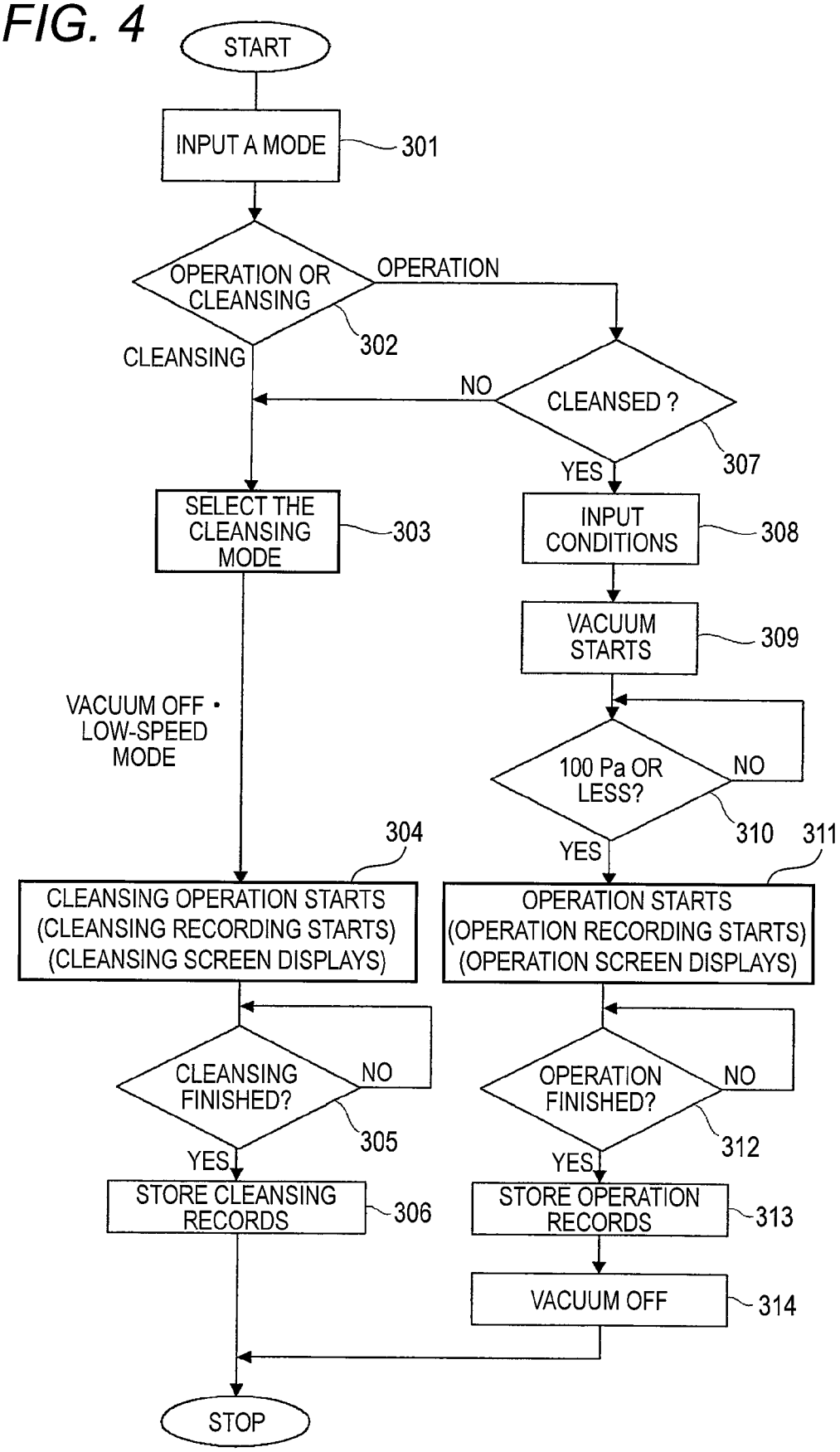
FIG. 4 is a flowchart showing the control order in the cleansing mode of the continuous centrifuge according to an embodiment.

Next, the control order in the cleansing mode of the continuous centrifuge 1 will be described using FIG. 4. The control shown in the flowchart in FIG. 4 is conducted by running a control program with a microcomputer, not shown, in the control apparatus 200. Firstly, before performing an operation using the continuous centrifuge 1, an operator inputs an operation mode using the operation panel 205 (Step 301).

In a case in which an operator selects the cleansing mode as an operation mode using a menu button 222 (refer to FIG. 3), the microcomputer executes the control order of the cleansing mode (Steps 303 and 304). The cleansing mode refers to a mode in which a liquid chemical is flowed through a specimen line so as to conduct sterilization or cleansing, and, after finishing a general centrifuging operation, sterilization by a liquid chemical is conducted by conducting the following operation without disassembling the rotor 120 from the chamber 101.

Firstly, the specimen tank 172 with a sterilization liquid therein is prepared, and the sterilization liquid is supplied to the rotor 120 by operating the specimen supply pump 173. The rotor 120 gradually fills with the sterilization liquid. If the sterilization liquid is continuously supplied for a while, the inside of the rotor 120 should be sterilized, but, in reality, air bubbles are left inside the rotor 120, therefore the sterilization liquid cannot come into contact with the rotor 120 or the core 120A at places in which air bubbles remain, and thus sufficient sterilization cannot be performed. Next, after confirming that the inside of the rotor 120 has been filled with the sterilization liquid, the operator pushes the CIP button 216 present on the operating panel 205 to start an operation in the cleansing mode while maintaining a state in which the sterilization liquid is continuously flowed (Step 304). In addition, the control unit starts the recording of the cleansing operation and displays the status on the trend display part 215 (refer to FIG. 3). Since it is not required to centrifuge a liquid chemical in the cleansing operation, the rotation speed of the motor 131 is set to, for example, about 1000 rpm so that the rotor 120 is rotated at a low speed. After starting the rotation of the rotor 120, the rotation speed is increased to 1000 rpm (rotations per minute) and then settled.

Here, in contrast to the rotation speed of from 35000 rpm to 40000 rpm when conducting general centrifuging, during the cleansing mode, the rotation speed is about 1000 rpm, which is a sufficiently low speed. In addition, the rotation speed of the rotor 120 is low, and thus there is no concern about temperature rise due to windage, therefore it is possible to rotate the rotor 120 under the atmospheric pressure environment without operating the vacuum pump, not shown. Since a centrifugal force is exerted on the sterilization liquid inside the rotor 120 due to the rotation of the rotor 120 and air bubbles left inside are definitely lighter than the sterilization liquid, the air bubbles gather around the center of the rotor 120. Since the sterilization liquid is continuously supplied, the air bubbles are pushed by the flow of the sterilization liquid from the lower side and flowed through the upper connector 175B from the upper shaft 123A, and then collected in the liquid waste collection tank 176.

After flowing the sterilization liquid for a sufficient time, the speed of the rotor 120 is reduced and stopped by pressing the CIP button 216 again. Once cleansing is finished, the obtained record of the cleansing operation is stored in the storage apparatus in the control apparatus 200 (Step 306). The operator communicates the passage 181B and the passage 181C in the three-way valve 181 and communicates the passage 182B and the passage 182C in the three-way valve 182 so that air in a clean room is flowed into the upper pipe 175A and the lower pipe 171A from the passage 182C in the three-way valve 182, and thus the sterilization liquid in the rotor 120 is collected through the passage 181C in the three-way valve 181 so as to make the rotor 120 empty, thereby finishing a sterilization treatment. Meanwhile, in the cleansing mode, sterilization and cleansing may be conducted simultaneously with a single solution, or a cleansing treatment may be conducted using a separate solution after conducting sterilization with a single solution. In the case of using a separate solution or pure water for cleansing, a treatment may be conducted in the same manner as the above with the specimen tank 172 including a cleansing liquid instead of a sterilization liquid. In addition, it is possible to satisfactorily maintain the sterilization state in the rotor 120 by fixing a High Efficiency Particulate Air (HEPA) filter, not shown, to the passage 182C in the three-way valve 182 so as to flow atmosphere (air) which has been filtered by the HEPA filter into the rotor 120 or flow in an inert gas, such as nitrogen gas, instead of atmosphere (air), and then shutting the passage 181B and the passage 182B in the three-way valve 181 and the three-way valve 182.

In Step 302, in a case in which an operation mode directed by an operator is a general centrifuging operation mode, the process moves to Step 307 in which the microcomputer determines whether cleansing has been done after the prior operation mode (Step 307). Such determination can be made based on the records of the centrifuging operation and the cleansing operation stored in the storage apparatus in the control apparatus 200. In a case in which cleansing has not been done, the operator is given an alarm to direct cleansing, and the process moves to Step 303. In a case in which cleansing has been done, the conditions of a centrifuging operation, such as the rotation speed of the rotor 120, the setting temperature, the degree of vacuum or the like, are input by the operator via the operating panel 205 (Step 308). Next, if the operator pushes the start button 220 on the operating panel 205, the control unit activates the vacuum pump, not shown, so as to reduce the pressure in the chamber 101 (Step 309). The control unit starts the recording of a general operation and displays the status on the trend display part 215 (refer to FIG. 3). Next, the control unit monitors whether the air pressure in the chamber 101 becomes 100 Pa or less (Step 310) and, if the air pressure becomes 100 Pa or less, the control unit starts the rotation of the rotor 120, thereby starting a centrifugal operation (Step 311).

Next, the control unit determines whether a predetermined centrifuging operation has been finished (Step 312) and, if the predetermined centrifuging operation has been finished, the control unit stops the rotation of the rotor 120 and stores the obtained record of the general operation in the storage apparatus in the control apparatus 200 (Step 313). Next, the operator pushes the vacuum button 219 (refer to FIG. 3) to stop the driving of the vacuum pump and put a vacuum opening valve in an 'open' state so as to put the inside of the chamber 101 in an atmospheric state (Step 314), thereby finishing the treatment.

As described above, according to the present embodiment, it is possible to conduct CIP sterilization by flowing a liquid chemical in the specimen line. Furthermore, in the cleansing mode, air bubbles left inside the rotor are discharged from the rotor by rotating the rotor at a low speed, therefore it is possible to conduct uniform and reliable sterilization. Furthermore, since the cleansing mode is conducted with the vacuum pump stopped, it is not necessary to wait for the degree of vacuum to reach a predetermined level from the atmospheric pressure, therefore the overall operation time is shortened and, furthermore, it is possible to achieve energy saving. Furthermore, since it is not necessary to prepare a sterilization tank for sterilization and, furthermore, the inside of the rotor is not exposed to the atmosphere after sterilization, it is possible to maintain a satisfactory sterilization state.

Embodiment 2

Figure 5:
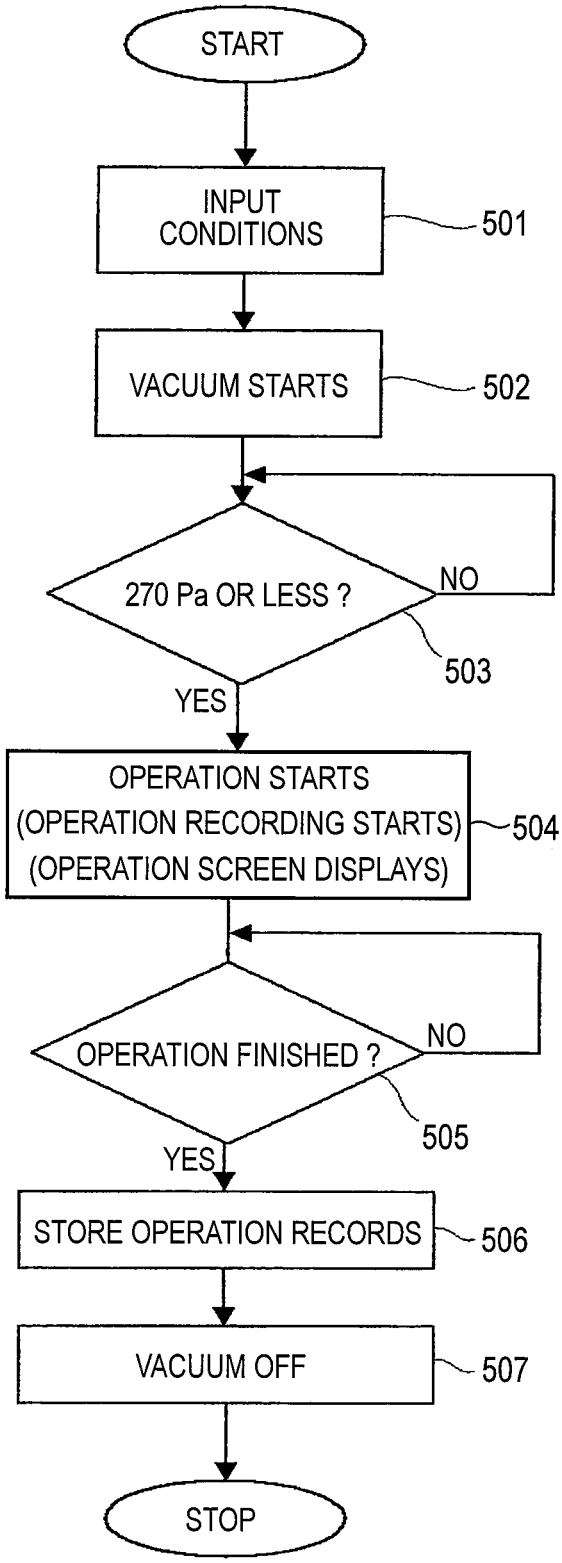
FIG. 5 is a flowchart showing the control order in the cleansing mode of the continuous centrifuge according to a second embodiment.

Next, the control order of the cleansing mode in the continuous centrifuge 1 according to the second embodiment will be described using FIG. 5. The flowchart in FIG. 5 is a substituted part of Steps 303 to 306 in FIG. 4, and the other treatment orders, not shown, are identical to those in FIG. 4. The difference of the second embodiment from the first embodiment is that the vacuum pump is activated in the cleansing mode. Since it is not necessary to rotate the rotor 120 at a high speed in the cleansing mode, the formation of a high vacuum state (for example 120 Pa or less), which is a necessary condition for a degree of vacuum enabling rotation when conducting general centrifuging, is not necessarily required, and it is possible to set a moderate condition for the degree of vacuum for the cleansing mode. For example, if the degree of vacuum is set to about 270 Pa or less, it is possible to shorten a time necessary for the inside of the chamber 101 to be pressure-reduced and to shorten the total time for an operation in the cleansing mode to finish.

Before the operation of the cleansing mode, the operator inputs the operation conditions of the cleansing mode at the operating panel 205 (Step 501) and then pushes the vacuum button 219 so as to start the driving of the vacuum pump, not shown, disposed in the control apparatus 200 and start the pressure-reduction of the inside of the chamber 101 (Step 502). Next, the specimen tank 172 with a sterilization liquid therein is prepared, and the sterilization liquid is supplied to the rotor 120 by operating the specimen supply pump 173. The rotor 120 gradually fills with the sterilization liquid. If the sterilization liquid is continuously supplied for a while, the inside of the rotor 120 should be sterilized, but, in reality, air bubbles are left inside the rotor 120, therefore the sterilization liquid cannot come into contact with the rotor 120 or the core 120A at places in which air bubbles remain, and thus sufficient sterilization cannot be performed.

Here, the operator confirms whether the degree of vacuum inside the chamber has become a predetermined degree of vacuum or less (for example, 270 Pa or less) (Step 503), and, after confirming that the inside of the rotor 120 has been filled with the sterilization liquid, the operator pushes the CIP button 216 present on the operating panel 205 to start the operation of the rotor while maintaining a state in which the sterilization liquid is continuously flowed (Step 504). Thereby, the rotation speed of the rotor 120 is increased to 1000 rpm (rotations per minute) and then settled.

Since a centrifugal force is exerted on the sterilization liquid inside the rotor 120 due to the rotation of the rotor 120 and air bubbles left inside are definitely lighter than the sterilization liquid, the air bubbles gather around the center of the rotor 120. Since the sterilization liquid is continuously supplied, the air bubbles are pushed by the flow of the sterilization liquid from the lower side and flowed through the upper connector 175B from the upper shaft 123A, and then collected in the liquid waste collection tank 176. After flowing the sterilization liquid for a sufficient time, the speed of the rotor 120 is reduced and stopped by pressing the CIP button 216 again. If there is a direction to finish the operation (Step 505), the control unit stores the operation record in the storage units, not shown (Step 506). After stopping the rotation of the rotor, the operator pushes the vacuum button 219 so as to stop the driving of the vacuum pump and put the vacuum opening valve in an 'open' state so as to put the inside of the chamber 101 in an atmospheric state (Step 507). Finally, the operator collects the sterilization liquid in the rotor 120 so as to make the rotor 120 empty, thereby finishing the sterilization and/or cleansing treatment.

As described above, according to the second embodiment, since the rotor chamber is pressure-reduced to a certain degree of vacuum, although it is not a high degree of vacuum for a general centrifuging operation, it is possible to conduct a sterilization and/or cleansing treatment while rotating the rotor at a relatively high rotation speed.

Further, the present embodiment suggests reliable sterilization by providing a cleansing mode and flowing a sterilization liquid while rotating the rotor 120 so as to discharge air bubbles left inside the rotor 120, but the above rotation speed of the rotor 120 of 1000 rpm is an example, therefore the rotation speed may be much slower as long as the speed can sufficiently discharge air bubbles, and, definitely, it is evident that a similar result can be obtained by flowing the sterilization liquid while rotating at an arbitrary rotation speed of between 1000 rpm to the rotation speed for general centrifuging (for example, 35000 rpm or 40000 rpm). The rotation speed of the rotor in the cleansing mode is preferably 1/10 or less of a maximum rotation speed of the rotor.

Embodiment 3

Figure 6:
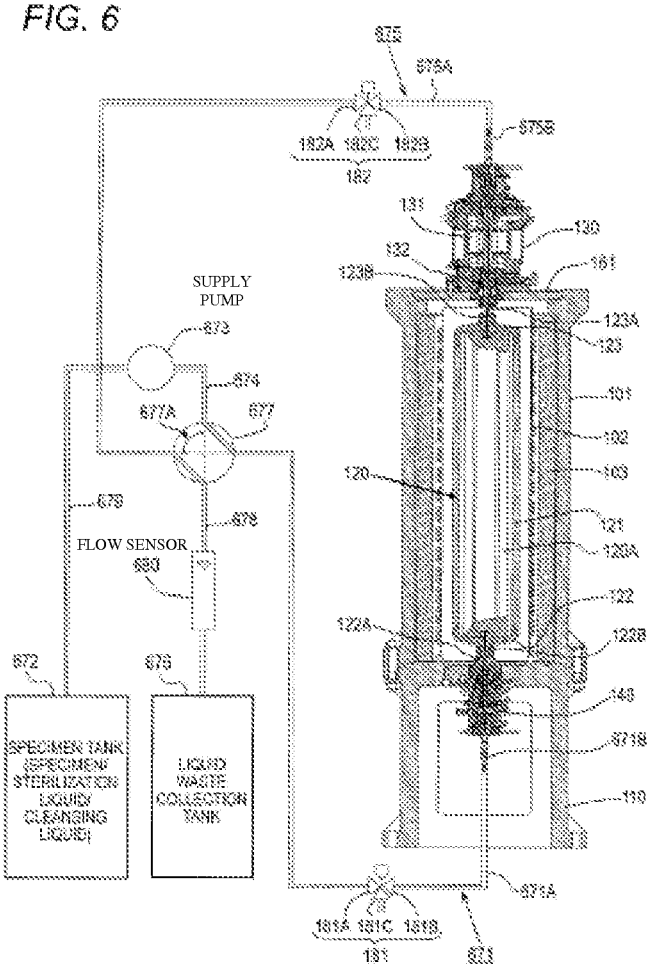
FIG. 6 is a cross-sectional view showing the detailed structure of the centrifuging unit according to a third embodiment.

Next, a third embodiment will be described using FIGS. 6 and 7. FIG. 6 is a cross-sectional view showing the detailed structure of the centrifuging unit according to the third embodiment. Similar units to the centrifuging unit shown in FIG. 2 are given similar reference numerals, and, since the structure thereof is identical, the description thereof will not be repeated. The difference between the third embodiment and the first embodiment is the structure of pipes from a specimen tank 672 and a liquid waste collection tank 676 to the rotor 120. The present embodiment is characterized by providing a specimen supply pump 673, a direction switching valve 677 and the three-way valve 181 in the middle of the pipe from the specimen tank 672 to a lower connector 671B.

The specimen tank 672 stores a specimen which is to be centrifuged in the rotor 120, and the specimen supply pump 673 pressure-feeds the specimen. During an operation in the cleansing mode, the specimen tank 672 accommodates a sterilization liquid or a cleansing liquid. The specimen pressure-fed by the specimen supply pump 673 is connected to either a lower pipe 671A or an upper pipe 675A depending on the direction setting of a direction switching valve 677. The direction switching valve 677 includes 4 ports and can use an electromagnetic switching valve capable of simultaneously switching the combinations of two ports in the entrance side and two ports in the exit side. The ports of the direction switching valve 677 are connected respectively with a specimen pipe 679 connected to the specimen tank 672, a liquid waste pipe 678 connected to a liquid waste collection tank 676, a lower pipe 671A connected to a lower connector 671B and an upper pipe 675A connected to an upper connector 675B.

The setting of the direction switching valve 677 in FIG. 6 displays a state in which a specimen is pressure-fed to the lower pipe 671A from the specimen tank 672. In the case of this setting, the upper pipe 675A is simultaneously connected to the liquid waste collection tank 676. This is the first setting position of the direction switching valve 677. In addition, by changing the setting of the direction switching valve 677 so as to rotate a valve 677A by 90 degrees counterclockwise from the position in the drawing, it is possible to set connection of the specimen tank 672 and the upper pipe 675A, and, simultaneously, connect the liquid waste collection tank 676 and the lower pipe 671A (the second setting position).

In a state in which the valve 677A in the direction switching valve 677 is set to be as in FIG. 6, a specimen which has been sucked from the specimen tank 672 and passed through the direction switching valve 677 passes through the lower bearing unit 140 and flows into the rotor 120, in which the specimen is to be centrifuged, and the supernatant (liquid waste) separated from the specimen in the rotor 120 passes through the driving unit 130 and reaches the upper pipe 675A, and then is collected in the liquid waste collection tank 676 through the direction switching valve 677 and the liquid waste pipe 678. In the present embodiment, a flow sensor 680 is provided between the direction switching valve 677 and the liquid waste collection tank 676 so as to measure the amount of liquid waste flowing into the liquid waste pipe 678 and then send the data to the control apparatus 200 (refer to FIG. 1).

In the second setting position in which the valve 677*a* in the direction switching valve 677 has been rotated by 90 degrees counterclockwise from the state in FIG. 6, a specimen which has been sucked from the specimen tank 672 and passed through the direction switching valve 677 passes through the upper pipe 675A and reaches the upper shaft 123A so as to flow into the rotor 120. Then, the supernatant (liquid waste) separated from the specimen in the rotor 120 passes through the lower shaft 122A and flows into the lower pipe 671A, then passes through the direction switching valve 677 and reaches the liquid waste collection tank 676. At this time, the amount of the supernatant flowing into the liquid waste collection tank 676 is measured by the flow sensor 680, and the data is sent to the control apparatus 200 (refer to FIG. 1).

As described above, in the third embodiment, by providing the direction switching valve 677, it is possible to select whether a specimen, a sterilization liquid and a cleansing liquid are flowed from the bottom side or top side of the rotor 120 even during rotation. In addition, such selection can be made during the operation of the rotor 120. Meanwhile, the three-way valves 181 and 182 are inserted between the lower pipe 671A and the upper pipe 675A. The three-way valve 181 has three passages of the passage 181A, the passage 181B and the passage 181C and can perform control in order to communicate any two passages of these. Similarly, the three-way valve 182 has three passages of the passage 182A, the passage 182B and the passage 182C and can perform control in order to communicate any two passages of these. Therefore, it is possible to conduct the discharge of a specimen or a liquid waste from the lower pipe 671A or the upper pipe 675A using the three-way valves 181 and 182 in addition to the sending of a specimen (cleansing liquid) by the direction switching valve 677. In the present embodiment, it is possible to realize various forms of cleansing operation or sterilization operation by conducting the control using the direction switching valve 677 and the three-way valves 181 and 182.

Next, the control order of the cleansing mode in the continuous centrifuge 1 according to the third embodiment will be described using the flowchart in FIG. 7. The flowchart in FIG. 7 is a substituted part of Steps 303 to 305 in FIG. 4, and the other treatment orders, not shown, are identical to those in FIG. 4. The third embodiment is characterized by switching the direction of flow of a cleansing liquid into the rotor 120 in the cleansing mode.

Firstly, before the operation of the cleansing mode, an operator inputs the number of times of flow path switching N and the cleansing time T which are the operation conditions in the cleansing mode through the operating panel 205 (Step 701). Here, the number of times of flow path switching N refers to the number of actions indicating how many times the cleansing action is to be repeated in which a single cleansing action includes the supply from the bottom of the rotor 120 and the supply from the top of the rotor 120. In addition, the cleansing time T refers to the cleansing time by the supply from the bottom of the rotor 120 and the supply from the top of the rotor 120, and indicates, for example several seconds or minutes. Next, the control apparatus 200 rotates the rotor 120 at a low speed (Step 702). In the cleansing mode, the rotor 120 is rotated at a lower speed than the rotation speed for conducting general centrifuging, for example, one tenth or less of the maximum rotation speed. Next, the control apparatus 200 controls the direction switching valve 677 to make the flow path in the rotor 120 be a direction of 'from the bottom to the top', that is, connects the specimen pipe 679 and the lower pipe 671A and connects the upper pipe 675A and the liquid waste pipe 678 (Step 703). In the present specification, such a connection state is called 'Bottom Feed'.

Next, the control apparatus 200 determines whether the cleansing time T has elapsed, and, in a case in which the time is yet to elapse, waits for the time to elapse (Step 704). Once the cleansing time T has elapsed, the control apparatus 200 controls the direction switching valve 677 to make the flow path in the rotor 120 be a direction of 'from the top to the bottom', that is, connects the specimen pipe 679 and the upper pipe 675A and connects the lower pipe 671A and the liquid waste pipe 678 (Step 705). In the present specification, such a connection state is called 'Top Feed'.

Next, the control apparatus 200 determines whether the cleansing time T has elapsed, and, in a case in which the time is yet to elapse, waits for the time to elapse (Step 706). Once the cleansing time T has elapsed, the control apparatus 200 decreases the number of times of flow path switching N by one (Step 707), and determines whether N becomes 0, and, if N is not 0, moves the process back to Step 703, and, if N becomes 0, finishes the treatment (Step 708).

As described above, the cleansing mode in the third embodiment is designed to flow a cleansing liquid not only from the bottom to the top of the rotor 120 but also from the top to the bottom. In general, if a liquid chemical (sterilization liquid) is flowed in only from the bottom of the rotor 120, air bubbles generated in the middle of the rotor 120 are light and thus gather around the rotation center. Then, air bubbles gathering around the center eject through the top. However, there are cases in which it is difficult to eject air bubbles generated in the bottom of the rotor 120 through the top only by flowing the liquid chemical in the bottom to top direction. Since the presence of air bubbles can hinder the contact of the liquid chemical with the inner wall of the rotor 120, the presence of air bubbles is not preferable from the standpoint of completely conducting sterilization by the liquid chemical. Therefore, in the present embodiment, after flowing the liquid chemical in the bottom to top direction of the rotor 120, the direction of flow of the liquid chemical is switched to flow the chemical in the top to bottom direction of the rotor 120 for a predetermined time, thereby effectively discharging air bubbles generated in the bottom of the rotor 120. With such an arrangement, the liquid chemical can come into satisfactory contact with the inner walls of the rotor 120, the lower shaft 122A and the upper shaft 123A, and therefore it is possible to conduct reliable sterilization.

Furthermore, in the third embodiment, since the flowing direction of the liquid chemical is switched in turn one or more times, it is possible to conduct cleansing and sterilization without taking the rotor 120 out of the chamber 101. Further, in the flowchart in FIG. 7, the number of times of flow path switching N is counted by counting a combination of 'Bottom Feed' and 'Top Feed' as one time, the number N may be counted by counting them separately, and it is possible to set the number of Bottom Feed as m and the number of Top Feed as n ($n=m\pm1$). In addition, in Step 703, the cleansing is started with 'Bottom Feed' when starting cleansing, but it is not limited thereto, and the cleansing may be started with 'Top Feed'.

Figure 7:
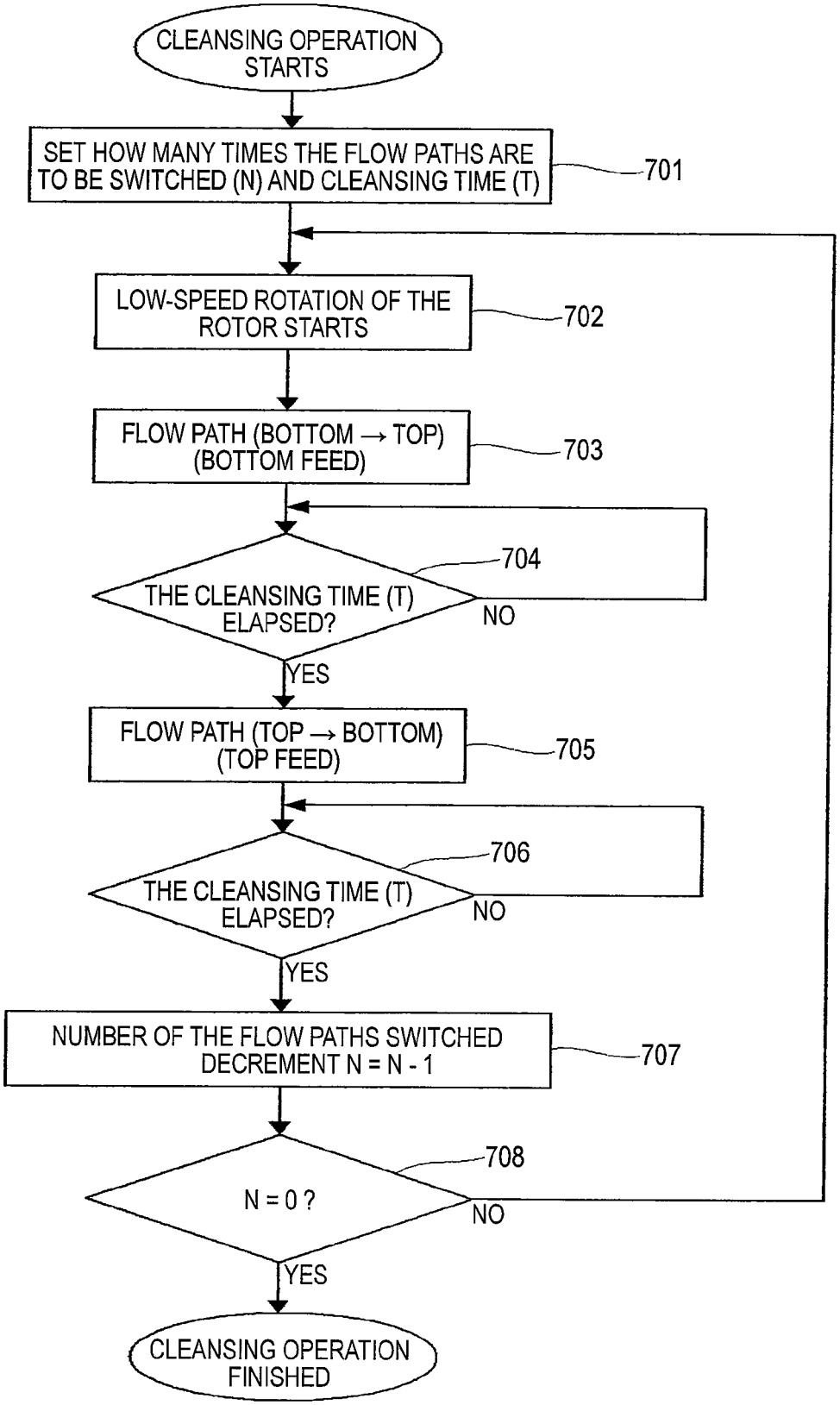
FIG. 7 is a flowchart showing the control order in the cleansing mode of the continuous centrifuge according to the third embodiment.

Furthermore, while executing Steps 703 to 708 in the flowchart in FIG. 7, the rotor 120 is made to rotate at a low speed, but the rotor 120 may be made to stop partially or entirely, and the rotation speed of the rotor 120 may be set to vary depending on the progress state of cleansing. Furthermore, timing of switching the direction switching valve 677 may be based on the amount of liquid waste flowing into the liquid waste collection tank 676 using the flow sensor 680.

Embodiment 4

Next, the fourth embodiment will be described using FIGS. 8 and 9. In the third embodiment, the flowing direction of a liquid chemical is switched by one electromagnetic switching valve-like direction switching valve 677 having 4 ports, but in the fourth embodiment the flow paths is connected in a bridge format and the flow paths is formed by combining four independent automatic valves 777A to 777D.

Figure 8:
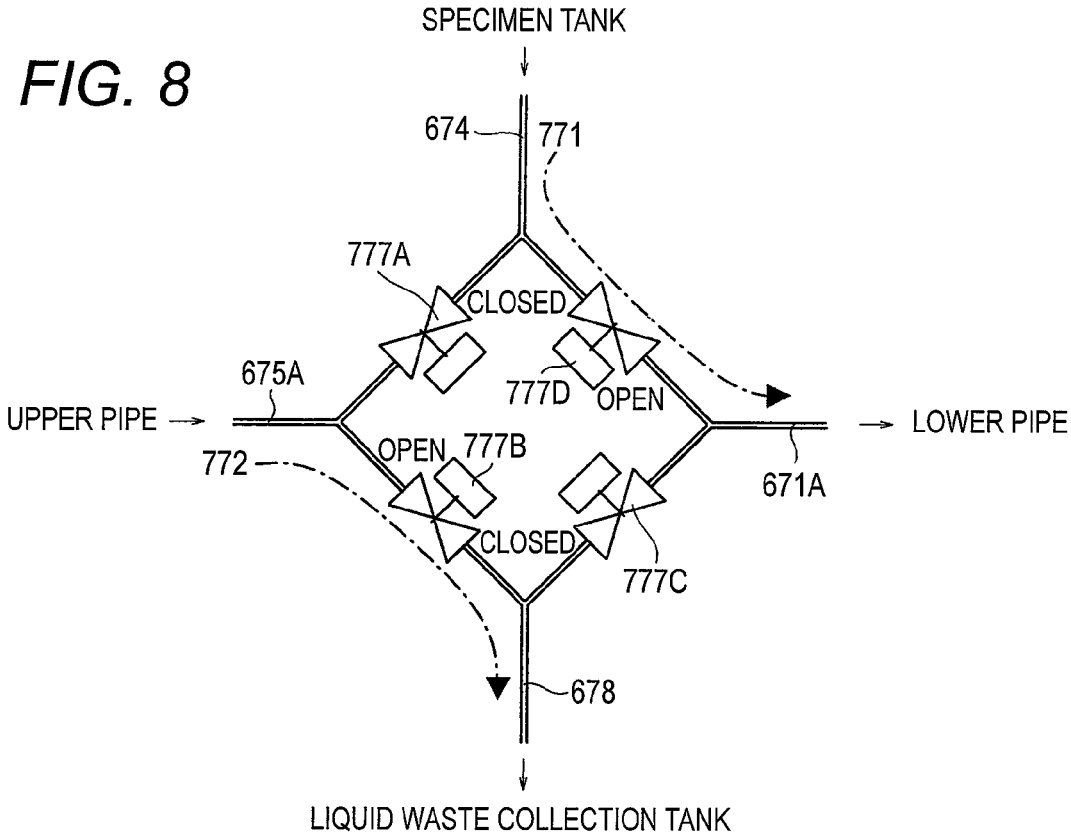
FIG. 8 is a view explaining the mechanism of the direction switching valve in the continuous centrifuge according to a fourth embodiment (the first of two).

In FIG. 8, a connection pipe 674 connected to the specimen tank 672 and the upper pipe 675A are assigned as the ports in the entrance side, and the lower pipe 671A and the liquid waste pipe 678 are assigned as the ports in the exit side. It is possible to achieve this state, that is, 'Bottom Feed' by making the automatic valve 777A closed, 777B open, 777C closed, and 777D open.

Figure 9:
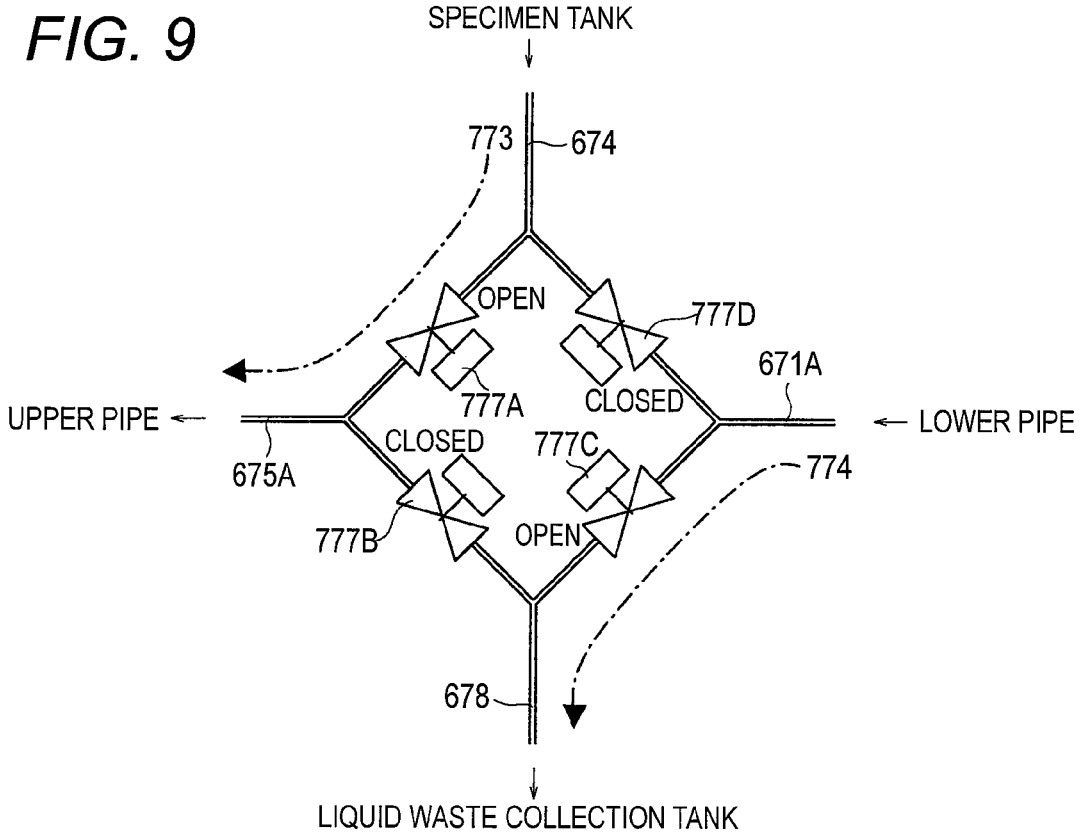
FIG. 9 is a view explaining the mechanism of the direction switching valve in the continuous centrifuge according to the fourth embodiment (the second of two).

FIG. 9 is a view showing a state in which the connected flow paths are switched by changing the open and closing states of the automatic valves 777A to 777D shown in FIG. 8. Here, the connection pipe 674 connected to the specimen tank 672 and the lower pipe 671A are assigned as the ports in the entrance side, and the upper pipe 675A and the liquid waste pipe 678 are assigned as the ports in the exit side. In addition, it is possible to achieve 'Top Feed' by making the automatic valve 777A open, 777B closed, 777C open, and 777D closed.

As described above, in the fourth embodiment, instead of the direction switching valve 677 (refer to FIG. 6), 'Bottom Feed' and 'Top Feed' can be achieved by the automatic valves 777A to 777D having an equivalent constitution thereto, therefore it is possible to flow a cleansing liquid in the top to bottom direction as well as in the bottom to top direction of the rotor 120, thereby achieving various formats of cleansing or sterilization.

Further, as the automatic valves 777A to 777D, arbitrary types of valves may be used, and electrically-operated valves or air pressure valves may be used as the type of the automatic valves. In addition, manual valves as well as automatic valves may be used to realize the present invention.

Thus far, the present invention has been described based on the embodiments, but the present invention is not limited to the above embodiments and various modifications can be made within the scope not departing from the gist of the present invention.

What is claimed is:

1. A continuous centrifuge comprising:

a cylindrical rotor configured to separate a specimen;

a centrifuging chamber accommodating the rotor;

a driving unit configured to rotate the rotor;

a specimen line configured to continuously supply and discharge the specimen to and from the rotor during rotation of the rotor, the specimen line including a pump configured to supply the specimen to the rotor and a valve configured to switch a flowing direction of liquid flowing through the specimen line; and a controller configured to control the driving unit, wherein the controller has a cleansing mode which flows a liquid chemical from a liquid chemical source through the specimen line so as to conduct sterilization and/or cleansing while rotating the rotor, wherein in the cleansing mode, the controller (i) controls the driving unit to rotate the rotor, (ii) controls the pump to flow the liquid chemical from a liquid chemical source and (iii) controls the valve to switch the flowing direction of the liquid chemical.

2. The continuous centrifuge according to claim 1, wherein in the cleansing mode, the controller controls the driving unit to rotate the rotor at a low speed enough to discharge air bubbles left inside the rotor to the specimen line.

3. The continuous centrifuge according to claim 2, wherein the rotation speed of the rotor in the cleansing mode is 1/10 or less of a maximum rotation speed of the rotor.

4. The continuous centrifuge according to claim 1 further comprising a vacuum pump connected with the centrifuging chamber to reduce inside pressure of the centrifuging chamber, wherein in the cleansing mode, the controller controls the driving unit to rotate the rotor in a state in which pressure-reduction level in the centrifuging chamber is closer to atmospheric pressure than in a general operation mode.

5. The continuous centrifuge according to claim 4, wherein the vacuum pump is stopped during an operation in the cleansing mode.

6. The continuous centrifuge according to claim 1, wherein the controller stores the operation state of the cleansing mode.

7. The continuous centrifuge according to claim 6, wherein the controller unit determines whether the cleansing mode has been finished based on the stored operation state when an operator directs a general centrifuging operation, and in a case in which the cleansing mode has not been finished, the controller does not start the general continuous centrifuging operation.

8. The continuous centrifuge according to claim 1 further comprising an operating panel configured to display operation states, wherein an icon is displayed on the operating panel to direct start of the cleansing mode.

9. A continuous centrifuge comprising:

a cylindrical rotor configured to separate a specimen;

a centrifuging chamber accommodating the rotor;

a driving unit configured to rotate the rotor;

a specimen line configured to continuously supply and discharge the specimen to and from the rotor during rotation of the rotor, the specimen line including an upper specimen line and a lower specimen line, a pump configured to supply the specimen to the rotor and a valve configured to switch a flowing direction of liquid flowing through the specimen line; and a controller configured to control the driving unit, wherein the controller has a cleansing mode which flows a liquid chemical from a liquid chemical source through the specimen line so as to conduct sterilization and/or cleansing while rotating the rotor, and wherein in the cleansing mode, the controller (i) controls the driving unit to rotate the rotor, (ii) controls the pump to flow the liquid chemical from a liquid chemical source and (iii) controls the valve to switch the flowing direction of the liquid chemical from one of the upper specimen line and the lower specimen line.

10. The continuous centrifuge according to claim 9 further comprising:

a liquid waste tank accommodating a liquid waste discharged from the rotor;

and wherein the pump is configured to send the liquid chemical from a specimen tank.

11. The continuous centrifuge according to claim 10, wherein the valve includes an electromagnetic valve, and the controller controls the electromagnetic valve so as to switch a connection from the specimen tank to one of the upper specimen line and the lower specimen line.

12. The continuous centrifuge according to claim 11, wherein, in the cleansing mode, sterilization liquid or cleansing liquid as the liquid chemical is supplied from the specimen tank through the lower specimen line to the rotor, and then the liquid chemical is supplied from the specimen tank through the upper specimen line to the rotor.

13. The continuous centrifuge according to claim 12, wherein, in the cleansing mode, control is made to repeatedly alternate the connection from the specimen tank to the lower specimen line and the connection from the specimen tank to the upper specimen line.

14. A continuous centrifuge comprising:

a cylindrical rotor configured to separate a specimen;

a centrifuging chamber accommodating the rotor;

a driving unit configured to rotate the rotor;

a specimen line configured to continuously supply and discharge the specimen to and from the rotor during rotation of the rotor, the specimen line including a pump configured to supply the specimen to the rotor and a valve configured to switch a flowing direction of liquid flowing through the specimen line; and a controller configured to control the driving unit, wherein the controller has a general centrifuging operation mode which flows the specimen through the specimen line and controls the driving unit to rotate the rotor at a first speed so as to separate the specimen, and a cleansing mode which flows a liquid chemical from a liquid chemical source through the specimen line and rotates the rotor at a second speed which is 1/10 or less of the first speed so as to conduct sterilization and/or cleansing while rotating the rotor, wherein in the cleaning mode, the controller (i) controls the driving unit to rotate the rotor, (ii) controls the pump to flow the liquid chemical from a liquid chemical source and (iii) controls the valve to switch the flowing direction of the liquid chemical.

* * * * *